US012209764B2

(12) United States Patent
Farley et al.

(10) Patent No.: US 12,209,764 B2
(45) Date of Patent: Jan. 28, 2025

(54) CLIMATE CONTROL SYSTEM

(71) Applicant: Rheem Manufacturing Company, Atlanta, GA (US)

(72) Inventors: Darryl Farley, Fort Smith, AR (US); Siva Gopalnarayanan, Plano, TX (US)

(73) Assignee: Rheem Manufacturing Company, Atlanta, GA (US)

( * ) Notice: Subject to any disclaimer, the term of this patent is extended or adjusted under 35 U.S.C. 154(b) by 62 days.

(21) Appl. No.: 17/469,981

(22) Filed: Sep. 9, 2021

(65) Prior Publication Data

US 2023/0072821 A1 Mar. 9, 2023

(51) Int. Cl.

| | |
|---|---|
| ***F24F 12/00*** | (2006.01) |
| ***F24F 11/81*** | (2018.01) |
| ***F24F 11/83*** | (2018.01) |
| ***F24F 13/30*** | (2006.01) |
| ***F24F 110/10*** | (2018.01) |
| ***F24H 6/00*** | (2022.01) |

(52) U.S. Cl.

CPC ..... *F24F 12/002* (2013.01); *F24F 11/81* (2018.01); *F24F 11/83* (2018.01); *F24F 13/30* (2013.01); *F24H 6/00* (2013.01); *F24F 2110/10* (2018.01)

(58) Field of Classification Search

CPC ..... F24F 12/002; F24F 11/81; F24F 11/83; F24F 13/30; F24F 2110/10; F24F 2221/34; F24F 2221/54; F24F 5/001; F24F 5/0096; F24H 6/00; F24H 3/065; F24D 5/04; F24D 5/12; F24D 19/1084

See application file for complete search history.

(56) References Cited

U.S. PATENT DOCUMENTS

| | | | | |
|---|---|---|---|---|
| 4,798,240 | A | 1/1989 | Gerstmann et al. | |
| 4,909,307 | A * | 3/1990 | Besik | F24H 3/065 165/4 |
| 5,772,113 | A | 6/1998 | Gerstmann et al. | |
| 5,879,154 | A | 3/1999 | Suchovsky | |

(Continued)

OTHER PUBLICATIONS

PCT, "International Search Report and Written Opinion" Application No. PCT/US2022/042432, mailed Jun. 12, 2022, 14 pages.

(Continued)

*Primary Examiner* — Nelson J Nieves
*Assistant Examiner* — Matthew John Moscola
(74) *Attorney, Agent, or Firm* — Eversheds Sutherland (US) LLP

(57) ABSTRACT

The present disclosure provides a climate control system including a first heat exchanger having a plurality of first channels to allow flow of water therethrough, a burner to heat the water in the first channels of the first heat exchanger, and an inducer disposed proximal to the burner to direct combustion air towards the burner for combustion, and vent products of combustion. The system further includes a hydronic coil-to-air heat exchanger in fluid communication with the first heat exchanger, to receive the heated water from the first heat exchanger. The hydronic coil-to-air heat exchanger includes a plurality of second channels to allow flow of heated water therethrough. The system also includes a blower to blow air across the plurality of second channels of the hydronic coil-to-air heat exchanger, whereby the air is heated by the heated water.

18 Claims, 3 Drawing Sheets

(56) References Cited

U.S. PATENT DOCUMENTS

| | | | | |
|---|---|---|---|---|
| 6,761,134 | B1 | 7/2004 | Trant | |
| 6,994,056 | B1 | 2/2006 | Boros | |
| 7,040,258 | B2 | 5/2006 | Peart et al. | |
| 11,512,800 | B2 | 11/2022 | Farley et al. | |
| 11,578,898 | B2 * | 2/2023 | Shin | F25B 13/00 |
| 2013/0125840 | A1 * | 5/2013 | De Santi | F24H 1/287 122/213 |
| 2014/0030662 | A1 * | 1/2014 | Noman | F23N 3/082 431/114 |
| 2014/0197243 | A1 * | 7/2014 | Cohen | F24H 15/204 237/50 |
| 2015/0021005 | A1 * | 1/2015 | Land, III | F24F 11/58 165/223 |
| 2015/0204578 | A1 | 7/2015 | Kaiser et al. | |
| 2015/0204579 | A1 | 7/2015 | Stewart et al. | |
| 2017/0176048 | A1 * | 6/2017 | Schneider | F24H 15/208 |
| 2019/0212033 | A1 * | 7/2019 | Consadori | F24H 1/523 |
| 2019/0226699 | A1 * | 7/2019 | Lundgreen | F24F 6/18 |
| 2021/0190328 | A1 * | 6/2021 | Deivasigamani | F24D 5/06 |
| 2021/0215400 | A1 * | 7/2021 | Taras | F24F 5/0096 |
| 2022/0042707 | A1 | 2/2022 | Farley et al. | |
| 2023/0003412 | A1 * | 1/2023 | Mathew | F24F 11/80 |
| 2023/0038602 | A1 | 2/2023 | Farley et al. | |

OTHER PUBLICATIONS

Unpublished U.S. Appl. No. 18/425,559, filed Jan. 29, 2024.
Unpublished U.S. Appl. No. 18/403,281, filed Jan. 3, 2024.

* cited by examiner

CLIMATE CONTROL SYSTEM

TECHNICAL FIELD

The present disclosure relates, in general, to a heating system and, more specifically relates, to a climate control system.

BACKGROUND

Heating systems are often used in cold climatic conditions to heat indoor space of buildings. Conventionally known heating systems function based on hydronics, where water is used as a heat transfer medium. Combined water and space heating systems are commonly known heating systems for thermal conditioning of the indoor space. In the combined water and space heating system, water is heated in an external source, such as a boiler or a water heater, and the heated water is discharged via pipes to a heat exchanger of an air handler. Air flowing across the heat exchanger is heated and further supplied into the indoor space. However, such systems depend on the external source for heated water supply and locating such systems in the interior of the buildings may be undesirable due to space limitations and complexity of installation. Additionally, in cases where demand for hot water from the external source is high, supply of hot water to heat exchanger may be insufficient and may therefore reduce efficiency of such space heating systems.

SUMMARY

According to one aspect of the present disclosure, a climate control system is disclosed. The climate control system includes a first heat exchanger comprising a plurality of first channels configured to allow flow of water therethrough, a burner configured to heat the water in the plurality of first channels of the first heat exchanger, and an inducer disposed proximal to the burner. The inducer is configured to: (i) direct combustion air towards the burner for combustion, and (ii) vent products of combustion. The climate control system further includes a hydronic coil-to-air heat exchanger in fluid communication with the first heat exchanger and configured to receive the heated water from the first heat exchanger. The hydronic coil-to-air heat exchanger includes a plurality of second channels configured to allow flow of heated water therethrough. The climate control system also includes a blower configured to blow air across the plurality of second channels of the hydronic coil-to-air heat exchanger, whereby the air is heated by the heated water.

In some embodiments, the climate control system further includes a first duct in fluid communication with the inducer and configured to vent the products of combustion, and a second duct configured to direct the heated air to an indoor space. The climate control system further includes a fuel supply device in fluid communication with the burner and configured to supply fuel to the burner. The air heated by the plurality of second channels of the hydronic coil-to-air heat exchanger is essentially free from products of combustion at the burner. In some embodiments, the burner is an ultra-low NOx burner.

In some embodiments, each of the first heat exchanger and the hydronic coil-to-air heat exchanger is one of a tube heat exchanger, finned tube heat exchanger, microchannel heat exchanger, mini channel heat exchanger or plate heat exchanger. In some embodiments, each channels of the plurality of first channels and the plurality of second channels is made of at least one of copper, aluminum, carbon steel, stainless steel, or alloys.

In some embodiments, the climate control system further includes a second heat exchanger in fluid communication with the hydronic coil-to-air heat exchanger and configured to: (i) receive warm water from the hydronic coil-to-air heat exchanger and (ii) supply cold water to the hydronic coil-to-air heat exchanger. The second heat exchanger is configured to allow exchange of heat between the warm water and a refrigerant. In some embodiments, the second heat exchanger is a part of an air conditioner.

In some embodiments, the climate control system further includes a temperature sensor configured to sense temperature of an indoor space, and a controller coupled to the temperature sensor and configured to actuate the burner and the blower based on temperature value of the indoor space being less than a desired temperature value. In some embodiments, air from the indoor space is recirculated to the blower. In some embodiments, the climate control system further includes a plurality of baffles disposed along a path of forced air.

According to another aspect of the present disclosure, a method of controlling climate of an indoor space is disclosed. The method includes receiving, by a controller, an input from a temperature sensor, the input indicative of temperature of the indoor space. The method further includes initiating a burner, by the controller, to heat water present in a plurality of first channels of a first heat exchanger, based on temperature value of the indoor space. The method further includes actuating, by the controller, a pump to circulate the water between the first heat exchanger and a hydronic coil-to-air heat exchanger. The method further includes actuating, by the controller, a blower to blow air across a plurality of second channels of the hydronic coil-to-air heat exchanger, whereby the air is heated by the heated water flowing through the plurality of second channels. The method also includes venting the heated air into the indoor space.

In some embodiments, the method further includes supplying fuel to the burner and venting products of combustion. The method further includes recirculating air from the indoor space to the blower. In some embodiments, the method further includes circulating cold water to the hydronic coil-to-air heat exchanger from a second heat exchanger of an air conditioner. In some embodiments, the method further includes circulating hot water to the hydronic coil-to-air heat exchanger from the second heat exchanger of the air conditioner.

These and other aspects and features of non-limiting embodiments of the present disclosure will become apparent to those skilled in the art upon review of the following description of specific non-limiting embodiments of the disclosure in conjunction with the accompanying drawings.

BRIEF DESCRIPTION OF THE DRAWINGS

A better understanding of embodiments of the present disclosure (including alternatives and/or variations thereof) may be obtained with reference to the detailed description of the embodiments along with the following drawings, in which.

DETAILED DESCRIPTION

Reference will now be made in detail to specific embodiments or features, examples of which are illustrated in the accompanying drawings. Wherever possible, corresponding, or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

As used herein, the terms "a", "an" and the like generally carry a meaning of "one or more," unless stated otherwise. Further, the terms "approximately", "approximate", "about", and similar terms generally refer to ranges that include the identified value within a margin of 20%, 10%, or preferably 5%, and any values therebetween.

Figure 1:
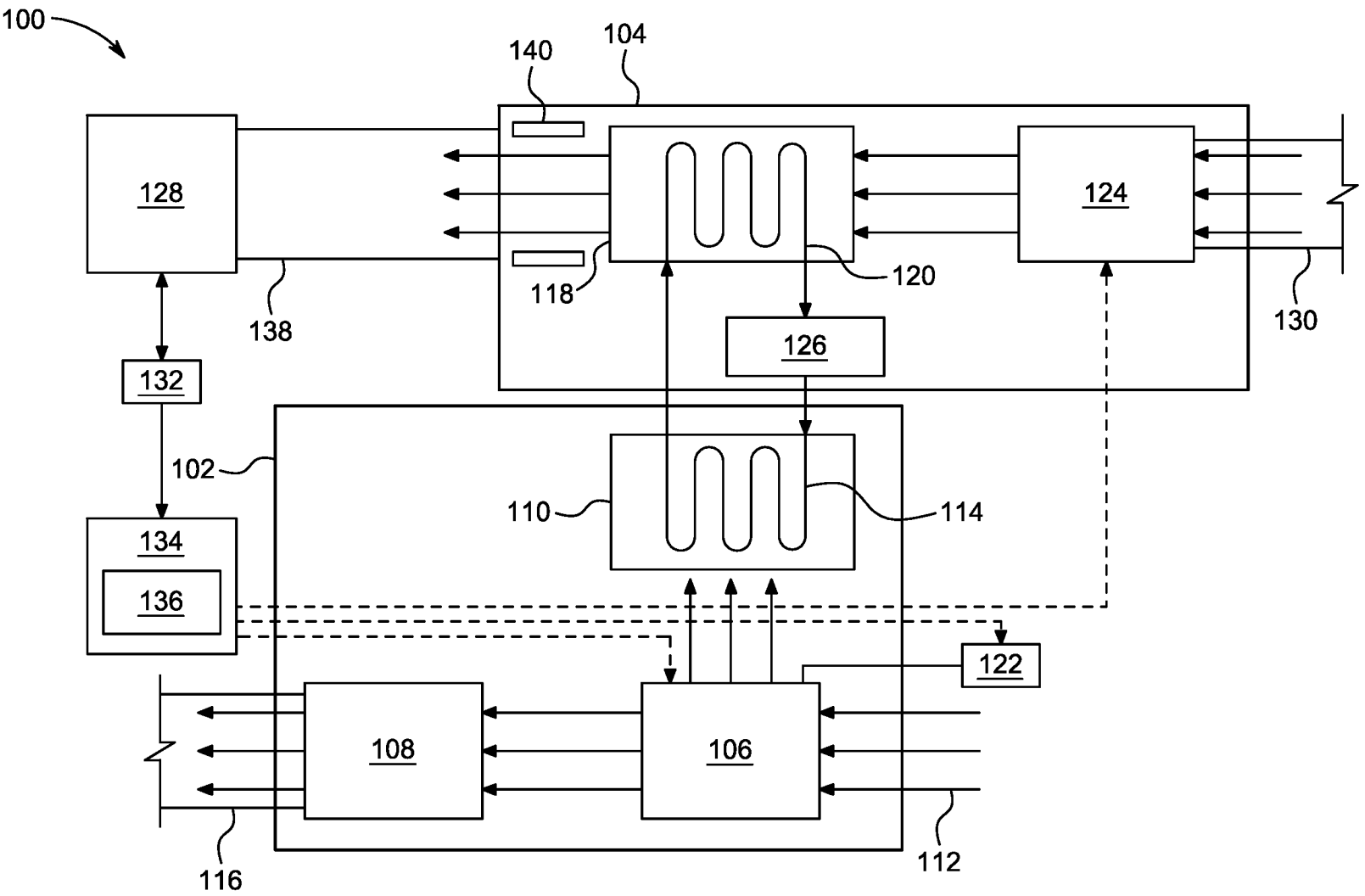
FIG. 1 is a schematic block diagram of a climate control system, according to an embodiment of the present disclosure.

Aspects of the present disclosure are directed to a standalone climate control system configured to heat and cool an indoor space, such as room or office space, without dependence on external system, such as a water heater. The climate control system includes an integrated burner with a closed loop water circuit, which together functions as a hydronic air handler. FIG. 1 illustrates a climate control system 100. As illustrated, the climate control system 100 includes a combustion chamber 102 and a heat transfer chamber 104 in fluid communication with the combustion chamber 102. In an embodiment, the combustion chamber 102 includes a burner 106, an inducer 108, and a first heat exchanger 110. Preferably, the burner 106 is a low NOx or an ultra-low NOx radiant burner having stainless steel construction, which is typically used in a tankless water heater. As such, the burner 106 may meet low emission standards. The climate control system 100 further includes a fuel supply device 122 in fluid communication with the burner 106 and configured to supply fuel to the burner 106. In some embodiments, supply of fuel to the burner 106 may be metered through one or more fuel supply valves (not shown). In an example, the fuel may be one of liquified petroleum gas, propane gas, hydrogen gas, or any known natural gas, or a combination thereof. The combustion chamber 102 may include a duct to allow flow of combustion air 112 towards the burner 106 to support combustion of the fuel. As used herein, the term "combustion air" refers to air that is supplied to burn the fuel in the burner 106. The first heat exchanger 110 includes a plurality of first channels 114 configured to allow flow of water therethrough. In an embodiment, the first heat exchanger 110 may be configured as one of, but not limited to, a tube heat exchanger, finned tube heat exchanger, microchannel heat exchanger, mini channel heat exchanger or plate heat exchanger. The first channels 114 may be made of at least one of, but not limited to, copper, aluminum, carbon steel, stainless steel, or alloys.

With the aid of fuel and the combustion air, the burner 106 is configured to heat the water in the first channels 114 of the first heat exchanger 110. The inducer 108 is disposed proximal to the burner 106 and configured to: (i) direct combustion air towards the burner 106 for combustion, and (ii) vent products of combustion, such as flue gas and other particles, from proximity of the burner 106 and first heat exchanger 110. As such, the inducer 108 may be embodied as one of a forced draft unit or an induced draft unit. The inducer 108 is operated by an inducer motor which is configured to initiate operation of the inducer 108 a few seconds prior to initiation of the burner 106, so that combustion air 112 is made available for the combustion at the burner 106. In some embodiments, a mixture of combustion air 112 and return air from the indoor space may be supplied to the burner 106. The climate control system 100 further includes a first duct 116 in fluid communication with the inducer 108 and configured to vent the products of combustion from the combustion chamber 102.

The heat transfer chamber 104 includes a hydronic coil-to-air heat exchanger 118 having a plurality of second channels 120. In an embodiment, the hydronic coil-to-air heat exchanger 118 may be one of a tube heat exchanger, finned tube heat exchanger, microchannel heat exchanger, mini channel heat exchanger or plate heat exchanger. The second channels 120 may be made of at least one of copper, aluminum, carbon steel, stainless steel, or alloys. The hydronic coil-to-air heat exchanger 118 is in fluid communication with the first heat exchanger 110 and configured to receive the heated water from the first heat exchanger 110. The second channels 120 are configured to allow flow of heated water therethrough.

A blower 124 disposed in the heat transfer chamber 104 is configured to blow air across the plurality of second channels 120, whereby the air is heated by the heated water flowing through the second channels 120. In some embodiments, the heat transfer chamber 104 may be separated from the combustion chamber 102 by use of a structural component, for example a plate. As such, the air flowing across and heated by the second channels 120 is essentially free from products of combustion at the burner 106. Further, a pump 126 is provided in fluid communication with an outlet of the hydronic coil-to-air heat exchanger 118 and an inlet of the first heat exchanger 110. As such, the pump 126 is configured to recirculate water from the hydronic coil-to-air heat exchanger 118 to the first heat exchanger 110, thereby defining a closed loop configuration for water flow. The climate control system 100 further includes a second duct 138 configured to direct the heated air to an indoor space 128 and a plurality of baffles 140 disposed along a path of forced air to direct the heated air towards the second duct 138. In some embodiments, the climate control system 100 may further include a return duct 130 configured to recirculate air from the indoor space 128 to the blower 124.

Actuation of the climate control system 100 may be based on temperature of the indoor space 128. In some embodiments, the climate control system 100 may include a temperature sensor 132 configured to sense temperature of the indoor space 128 and a controller 134 configured to actuate the climate control system 100 based on the temperature of the indoor space 128. In an embodiment, the controller 134 may be implemented as a processor, such as one or more microprocessors, microcomputers, digital signal processors, central processing units, state machines, logic circuitries, or any devices that manipulate signals based on operational instructions. Among other capabilities the processor may be configured to fetch and execute computer-readable instructions stored in a memory 136 thereof. Various functions of the processor may be provided using dedicated hardware as well as hardware capable of executing software in association with appropriate software. When provided by the processor, the functions may be provided by a single dedicated processor, by a single shared processor, or by a plurality of individual processors. Moreover, explicit use of the term "processor" should not be construed to refer exclusively to hardware capable of executing software, and may implicitly include, but not limited to, digital signal processor (DSP) hardware, network processor, application specific integrated circuit (ASIC), field programmable gate array (FPGA), read only memory (ROM) for storing software, random access memory (RAM), and non-volatile storage. Other hardware known to a person skilled in the art may also be included.

In operation, the controller 134 is configured to receive an input, in form of a signal, from the temperature sensor 132 and determine if the temperature of the indoor space 128 is less than a desired temperature value. In an embodiment, the desired temperature value may be set by the user, via, for example, a user interface (not shown) communicably coupled to the controller 134. In one example, the user interface may be implemented as a keypad, or a touch pad disposed on the climate control system 100 and configured to receive inputs from the user. In another example, the user interface may be implemented as a user personal device, such as a smartphone, a laptop, and the like, and configured to communicate an input to the controller 134. The input received from the user may be stored in the memory 136 of the controller 134. As such, based on the weather condition, the user may change the value of the desired temperature. When the temperature of the indoor space 128 is less than the desired temperature value stored in the memory 136, the controller 134 is configured to actuate the burner 106 and the blower 124. In some embodiments, the controller 134 may be configured to initiate operation of the inducer 108 a few seconds prior to the initiation of the burner 106 and initiate operation of the pump 126 a few seconds after the initiation of the burner 106. Such operation allows sufficient amount of combustion air 112 available at the burner 106 to support combustion and sufficient time for the water in the first channels 114 of the first heat exchanger 110 to be heated prior to being supplied to the hydronic coil-to-air heat exchanger 118, respectively. Additionally, initiation of the blower 124 may be delayed by a predefined time period to prevent an initial surge of cold air through the second duct 138 and into the indoor space 128.

The climate control system 100 may be housed in a heavy gauge pre-paint galvanized steel cabinet located indoor or outdoor. As such, the cabinet may be located in many possible locations, including, for example, a room in a building to be heated, a nearby shed, a garage, a basement, or any other suitable location. The first duct 116 may function as a flue and may enhance thermal and combustion efficiency of the burner 106 by venting the products of combustion from the combustion chamber 102. Accordingly, the cabinet may be located near an existing chimney of the building.

In an embodiment, the controller 134 may be a part of a control board integrated to the cabinet. In cases where the temperature sensor 132 is faulty, the controller 134 may actuate the climate control system 100 based on ambient temperature. For example, the controller 134 may be coupled to an ambient temperature sensor (not shown) configured to sense ambient temperature. Based on an input from the ambient temperature sensor, the controller 134 may be configured to determine if the ambient temperature value is less than the desired temperature value set by the user. Based on the determination, the controller 134 may initiate the operation of the burner 106, the blower 124, and other components as described earlier. In such instances, the controller 134 may additionally be configured to notify the user regarding a faulty state of the temperature sensor 134 and a demand mode executed by the controller 134, during such faulty state, for the actuation of the climate control system 100.

Operation of the climate control system 100 may be in progress until the user manually turns off the climate control system 100 or when the temperature value of the indoor space 128 is beyond a predetermined range with respect to the desired temperature value. The blower 124 may remain functional for a predetermined time period, upon stopping the operation of the climate control system 100, to extract residual heat from the hydronic coil-to-air heat exchanger 118 to the air. In some embodiments, the controller 134 may be configured to regulate temperature of the heated air supplied into the indoor space 128. For example, the second duct 138 may house a temperature sensor to sense temperature of the heated air flowing therethrough. The controller 134 may be communicably coupled to such temperature sensor to receive inputs regarding temperature value of the heated air. Additionally, the controller 134 may be configured to control the fuel supply device 122 to control supply of fuel to the burner 106, so that heating of the water in the first heat exchanger 110 may be regulated. As such, temperature of the air being supplied to the indoor space 128 may be regulated.

Figure 2:
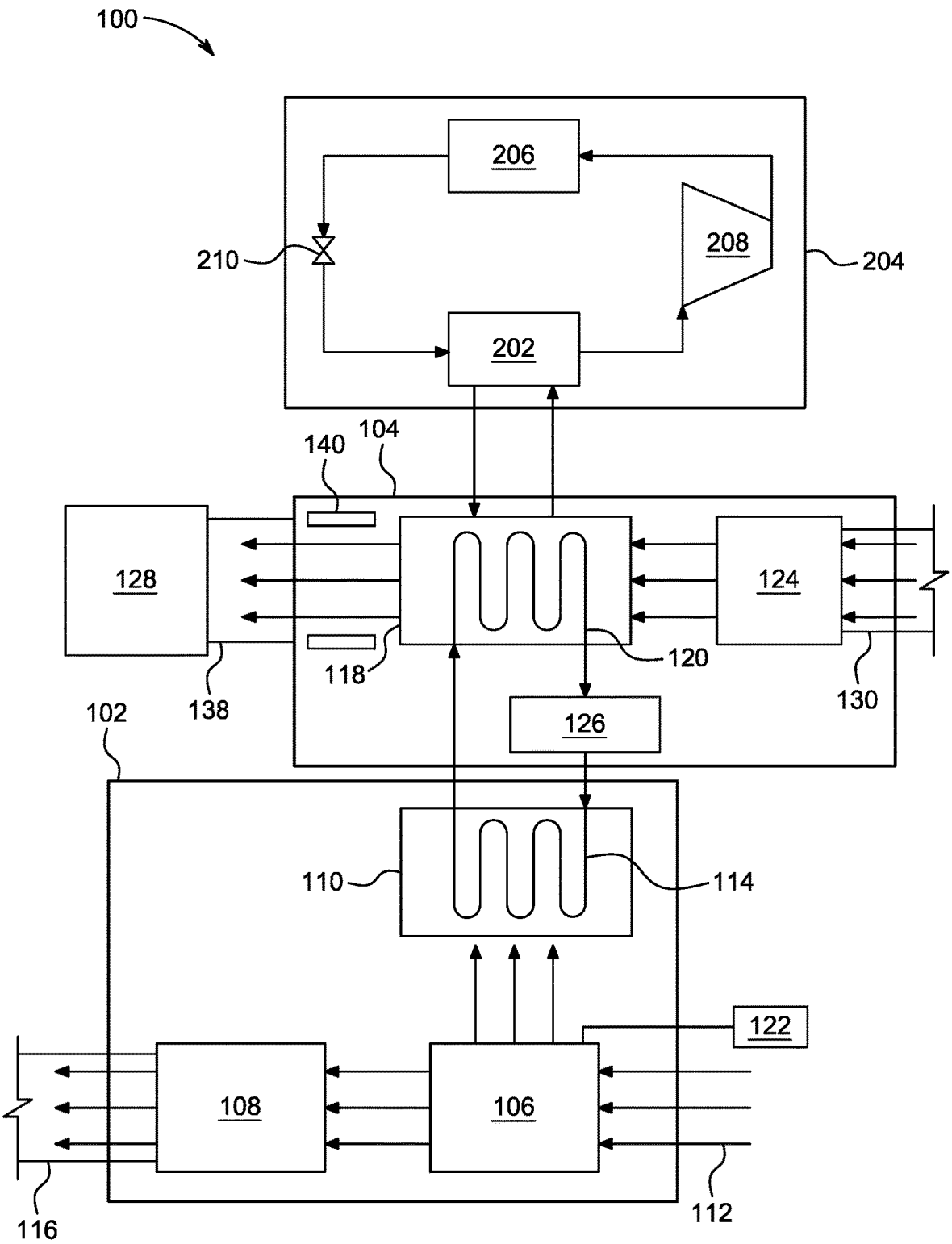
FIG. 2 is a schematic block diagram of a climate control system, according to another embodiment of the present disclosure.

FIG. 2 illustrates a schematic block diagram of the climate control system 100, according to another embodiment of the present disclosure. The climate control system 100 may further include a second heat exchanger 202 in fluid communication with the hydronic coil-to-air heat exchanger 118. In an embodiment, the second heat exchanger 202 may be a part of a refrigeration system, such as an air conditioner 204, that also includes a condenser 206, a compressor 208, and an expansion valve 210.

Upon losing heat to the air blown by the blower 124, the water (warm water) exiting the hydronic coil-to-air heat exchanger 118 is circulated further through the second heat exchanger 202, which may be implemented as a water-to-refrigerant heat exchanger. The second heat exchanger 202 is configured to (i) receive warm water from the hydronic coil-to-air heat exchanger 118 and (ii) supply cold water to the hydronic coil-to-air heat exchanger 118. As such, the second heat exchanger is configured to allow exchange of heat between the warm water and a refrigerant. In an embodiment, the cold water from the second heat exchanger 202 may be supplied to the first heat exchanger 110 for cooling. In another embodiment, the hydronic coil-to-air heat exchanger 118 may function as a cooling coil owing to the flow of the cold water therethrough, where the cold water received from the second heat exchanger cools the return air blown by the blower 124. In such cooling mode, the burner 106 is turned OFF. In case of heat pump heating mode, the second heat exchanger 202 functions as a condenser where heat from the refrigerant is absorbed by the water flowing through the second heat exchanger 202. Thus, the hot water from the second heat exchanger 202 may be supplied to the first heat exchanger 110 for heating. In parallel, the hot water also heats the air blown by the blower 124. In such heating mode, the burner 106 may or may not be functioning depending on heating demand.

Figure 3:
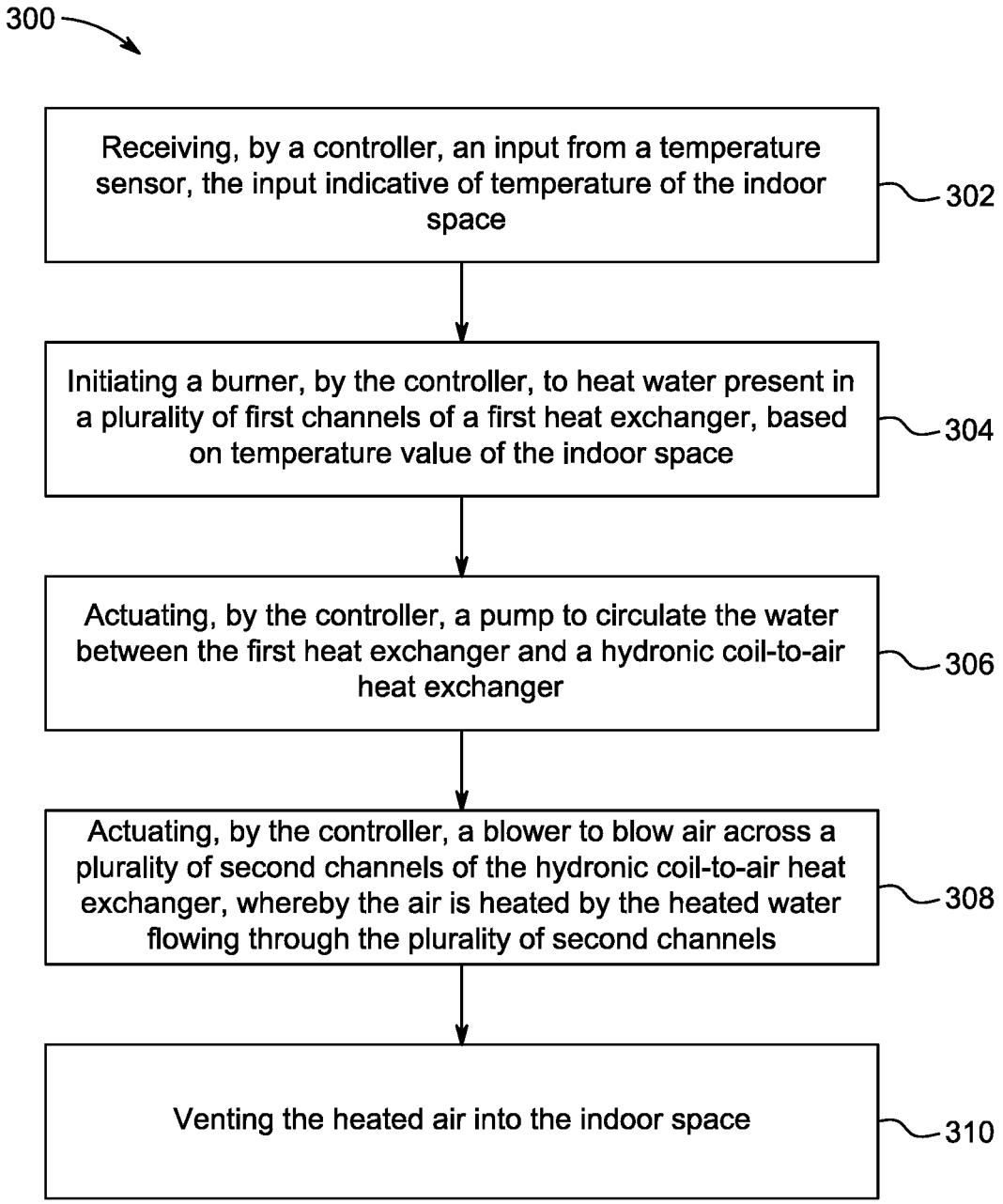
FIG. 3 is a flowchart of a method of heating an indoor space, according to an embodiment of the present disclosure.

FIG. 3 illustrates a flowchart of a method 300 of controlling climate of the indoor space 128. The method 300 is described in conjunction with FIG. 1 and FIG. 2. The order in which steps of the method 300 are described should not be construed as limitation. Any number of method blocks may be combined and eliminated in any manner. In an embodiment, the method 300, at step 302, includes receiving, by the controller 134, an input from the temperature sensor 132 indicative of temperature of the indoor space 128.

At step 304, the method 300 includes initiating the burner 106, by the controller 134, to heat water present in the plurality of first channels 114 of the first heat exchanger 110, based on temperature value of the indoor space 128.

At step 306, the method 300 includes actuating, by the controller 134, the pump 126 to circulate the water between the first heat exchanger 110 and the hydronic coil-to-air heat exchanger 118.

At step 308, the method 300 includes actuating, by the controller 134, the blower 124 to blow air across the plurality of second channels 120 of the hydronic coil-to-air heat exchanger 118, whereby the air is heated by the heated water flowing through the plurality of second channels 120. At step 310, the method 300 includes venting the heated air into the indoor space 128.

Although not specifically illustrated through blocks in FIG. 3, the method 300 further includes supplying fuel to the burner 106, venting products of combustion, and recirculating air from the indoor space 128 to the blower 124. In some embodiments, the method 300 also includes circulating cold water to the hydronic coil-to-air heat exchanger 118 from the second heat exchanger 202 of the air conditioner 204. In some embodiments, the method 300 also includes circulating hot water to the hydronic coil-to-air heat exchanger 118 from the second heat exchanger 202 of the air conditioner 204.

The present disclosure provides the climate control system 100 having high efficiency, reliability, stability, and quality. Since the burner 106 and other components of the tankless water heater are integrated within the cabinet, the climate control system 100 may function without dependence on external source for heated water supply. Also, since all components are positioned within one cabinet, the climate control system 100 may occupy minimum space with simple installation procedure associated with reduced costs and hence may be located indoors. Additionally, the closed loop of water between the hydronic coil-to-air heat exchanger 118 and the first heat exchanger 110 ensures fixed volume of water, thereby enhancing efficiency of the climate control system 100. As such, existing source of hot water within the building, such as tankless water heater, may be retained by the user for sole purpose of meeting demands of hot water for end-use applications, without the need to supply hot water to the climate control system 100. Further, the arrangement of components in the climate control system 100, such as position of the blower 124 with respect to the hydronic coil-to-air heat exchanger 118, allows lower watt consumption, thereby rendering the climate control system 100 energy efficient. The use of baffles 140 eliminates the need to manage heat exchanger wall temperatures as in case of gas furnaces, thereby minimizing air side pressure drop. Furthermore, the configuration of the climate control system 100 may minimize thermal acoustic issues. The climate control system 100 may also be implemented in geothermal systems to supplement heat generation and may reduce use of costly heating strips.

While aspects of the present disclosure have been particularly shown and described with reference to the embodiments above, it will be understood by those skilled in the art that various additional embodiments may be contemplated by the modification of the disclosed methods without departing from the spirit and scope of what is disclosed. Such embodiments should be understood to fall within the scope of the present disclosure as determined based upon the claims and any equivalents thereof. For example, size and shape of individual components may be altered to achieve a compact design of the climate control system 100. In addition, the burner 106 and the first heat exchanger 110 may be efficiently located within the cabinet to allow for effective use of interior space. Various types and amounts of insulation may be used to improve combustion efficiency and safety. In some embodiments, the climate control system 100 may include heat transfer liquids to enhance heat transfer efficiency, and miniature heating device to prevent freezing of portions of the heat exchangers.

What is claimed is:

1. A climate control system comprising:

a first heat exchanger comprising a first plurality of channels configured to allow flow of water therethrough;

a burner configured to heat the water in the first plurality of channels of the first heat exchanger, wherein the burner is initiated based on a temperature value of an indoor space;

an inducer configured to: (i) direct combustion air towards the burner for combustion, and (ii) vent products of combustion, wherein the inducer is actuated responsive to initiation of the burner;

a hydronic coil-to-air heat exchanger in fluid communication with the first heat exchanger and configured to receive heated water from the first heat exchanger, the hydronic coil-to-air heat exchanger comprising a second plurality of channels configured to allow flow of heated water therethrough;

a blower configured to blow air across the second plurality of channels of the hydronic coil-to-air heat exchanger, whereby the air is heated by the heated water, wherein the blower is actuated responsive to initiation of the burner; and a second heat exchanger in fluid communication with the hydronic coil-to-air heat exchanger and configured to: (i) receive warm water from the hydronic coil-to-air heat exchanger, (ii) supply cooled water to the hydronic coil-to-air heat exchanger, and (iii) supply hot water to the first heat exchanger;

wherein during a first heating operation, the burner is configured to switch off while the second heat exchanger supplies the hot water to the first heat exchanger, and wherein during a second heating operation, the burner is configured to continue operation while the second heat exchanger supplies the hot water to the first heat exchanger.

2. The climate control system of claim 1 further comprising a first duct in fluid communication with the inducer and configured to vent the products of combustion.

3. The climate control system of claim 1 further comprising a second duct configured to direct the heated air to an indoor space.

4. The climate control system of claim 1, wherein each of the first heat exchanger and the hydronic coil-to-air heat exchanger is one of a tube heat exchanger, finned tube heat exchanger, microchannel heat exchanger, mini channel heat exchanger or plate heat exchanger.

5. The climate control system of claim 1, wherein each channels of the first plurality of channels and the second plurality of channels is made of at least one of copper, aluminum, carbon steel, stainless steel, or alloys.

6. The climate control system of claim 1, wherein the air heated by the second plurality of channels of the hydronic coil-to-air heat exchanger is free from products of combustion at the burner.

7. The climate control system of claim 1, wherein the second heat exchanger is configured to allow exchange of heat between the warm water and a refrigerant.

8. The climate control system of claim 1, wherein the second heat exchanger is a part of an air conditioner.

9. The climate control system of claim 1 further comprising:

a temperature sensor configured to sense the temperature of the indoor space; and a controller coupled to the temperature sensor and configured to actuate the burner and the blower based on temperature value of the indoor space being less than a desired temperature value.

10. The climate control system of claim 9, wherein air from the indoor space is recirculated to the blower.

11. The climate control system of claim 1 further comprising a plurality of baffles disposed along a path of forced air.

12. A climate control system comprising:

a first heat exchanger comprising a first plurality of channels configured to allow flow of water therethrough;

a burner coupled the first heat exchanger, the burner configured to heat the water in the first plurality of channels of the first heat exchanger;

an inducer coupled to the burner;

a second heat exchanger in fluid communication with the first heat exchanger, the second heat exchanger comprising a second plurality of channels configured to allow flow of heated water therethrough;

a blower coupled to the second heat exchanger, the blower configured to blow air across the second plurality of channels of the second heat exchanger, whereby the air is heated by the heated water, and wherein the blower is actuated responsive to initiation of the burner; and a third heat exchanger in fluid communication with the second heat exchanger, the third heat exchanger configured to: (i) receive warm water from the second heat exchanger, (ii) supply cooled water to the second heat exchanger, and (iii) supply hot water to the first heat exchanger;

wherein during a first heating operation, the burner is configured to switch off while the third heat exchanger supplies the hot water to the first heat exchanger, and wherein during a second heating operation, the burner is configured to continue operation while the third heat exchanger supplies the hot water to the first heat exchanger.

13. The climate control system of claim 12, wherein the climate control system operates to further direct water from the third heat exchanger to the first heat exchanger.

14. The climate control system of claim 12, wherein:

the burner and the first heat exchanger are both disposed in a first enclosure;

the second heat exchanger is disposed in a second enclosure that is physically separated from the first enclosure.

15. The climate control system of claim 14, wherein the third heat exchanger is disposed in a third enclosure that is separate from the first and the second enclosures.

16. The climate control system of claim 12, wherein the air heats up as it traverses the second heat exchanger.

17. The climate control system of claim 12, further comprising a pump coupled to the first and the second heat exchangers, the pump operable to circulate water between the first and the second heat exchangers.

18. The climate control system of claim 12, wherein the third heat exchanger is a water-to-refrigerant heat exchanger.

* * * * *